United States Patent [19]

Gronlund et al.

[11] Patent Number: 4,681,289

[45] Date of Patent: Jul. 21, 1987

[54] SIDE MOUNTING BRACKET FOR DRAWER SLIDE

[75] Inventors: Robert L. Gronlund, Lewisburg; John Stewart, Selinsgrove, both of Pa.

[73] Assignee: Knape & Vogt Manufacturing Company, Grand Rapids, Mich.

[21] Appl. No.: 846,218

[22] Filed: Mar. 31, 1986

[51] Int. Cl.[4] ..... A47B 88/00

[52] U.S. Cl. ..... 248/224.4; 248/243; 248/201; 248/251; 312/350; 312/346

[58] Field of Search ..... 248/251, 243, 222.2, 248/224.3, 231.8, 272, 224.4, 223.4, 205.1, 201; 312/350, 346, 347, 341 R; 348/18, 19, 22

[56] References Cited

U.S. PATENT DOCUMENTS

| | | | |
|---|---|---|---|
| 2,940,711 | 6/1960 | Peters | 248/205.1 |
| 2,988,315 | 6/1961 | Saxe | 248/221.2 |
| 3,243,247 | 3/1966 | Knape | 312/333 |
| 3,278,250 | 10/1966 | Vogt | 312/339 |
| 3,298,768 | 1/1967 | Vogt | 312/339 |
| 3,840,944 | 10/1974 | Gresley | 248/223.4 |
| 4,138,176 | 2/1979 | Cowdroy | 312/350 |
| 4,147,393 | 4/1979 | Nelson | 312/350 |
| 4,193,649 | 3/1980 | Sharon | 248/243 |
| 4,566,743 | 1/1986 | Henriott | 312/350 |

FOREIGN PATENT DOCUMENTS

| | | | |
|---|---|---|---|
| 1063713 | 3/1967 | United Kingdom | 248/223.4 |

*Primary Examiner*—Reinaldo P. Machado
*Assistant Examiner*—Alvin Chin-Shue
*Attorney, Agent, or Firm*—Price, Heneveld, Cooper, DeWitt and Litton

[57] ABSTRACT

Vertically adjustable mounting apparatus for drawer rails embodying a rigid polymeric fastener shell that specially receives and envelopes a metal V-clip support having upper and lower tabs for insertion in vertically spaced slots of a pilaster strip, the shell having an inner end opening and a contiguous configurated slide channel to receive the metal clip, an abutment surface below said opening for abutment against the pilaster strip, and an alignment tab below said abutment surface to engage in the slot of a pilaster strip. The outer end of the shell receives a fastener that attaches a rail thereto. Preferably a twist clip engageable in a pilaster slot beneath the shell has a portion for locking engagement with the shell to lock the assembly in position.

11 Claims, 14 Drawing Figures

SIDE MOUNTING BRACKET FOR DRAWER SLIDE

BACKGROUND OF THE INVENTION

This invention relates to mounting brackets for drawer slides, particularly side mounting brackets.

Telescoping drawer slides of the types for example in U.S. Pat. Nos. 3,243,247, 3,278,250 and 3,298,768 have heretofore been mounted in a variety of ways, including the use of slotted pilaster strips. These prior mounting mechanisms also include the vertically adjustable assembly in U.S. Pat. 4,147,393. Such an adjustable combination utilizes a block shaped polymeric slide element retained within a channel formed by a surrounding metal clip. Although this prior combination is highly practical, useful and effective in providing an adjustable drawer rail mounting, it is rather expensive to manufacture.

SUMMARY OF THE INVENTION

The present invention employs to advantage the previously existing metal V-clip supports (which are customarily attached at preselected vertical locations on standard pilaster strips), by combining such clip supports with a unique polymeric fastener shell. The novel fastener shell comprises a hollow, polymeric rigid member which receives and envelopes an individual V-clip support with which it cooperates and to which is secured a slide rail. The fastener shell has an inner end and an outer end, the inner end including an opening communicating with a configurated interior slide channel into which the joined legs and apex of the V-clip support specially fit. Beneath the opening is a pilaster abutment surface which includes an alignment tab to project into one of the slots of the pilaster strip, beneath the V-clip support. At the lowermost portion of the shell and the abutment surface is a locking shoulder cooperative with a novel twist lock holding clip. The holding clip has a configurated, T-shaped tongue insertable into a pilaster slot beneath the polymeric shell, and rotatable with the holding clip to secure the clip to the pilaster strip while engaging the locking shoulder on the polymeric shell for locking the assembly firmly in place.

The novel polymeric component, in cooperation with the standard V-clip, achieves vertically adjustable side mounting for drawer slides at a small fraction of the cost of the previous device in U.S. Pat. No. 4,417,393. It can be utilized on existing furniture to mount existing drawer slide mechanisms.

These and other features, objects and advantages will be apparent upon studying the detailed disclosure to follow.

DESCRIPTION OF THE PREFERRED EMBODIMENT

Figure 1:
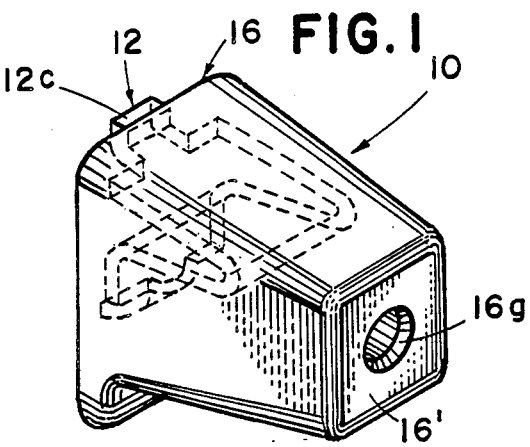
FIG. 1 is a perspective view of the polymeric rigid shell and cooperative V-clip support.
Figure 2:
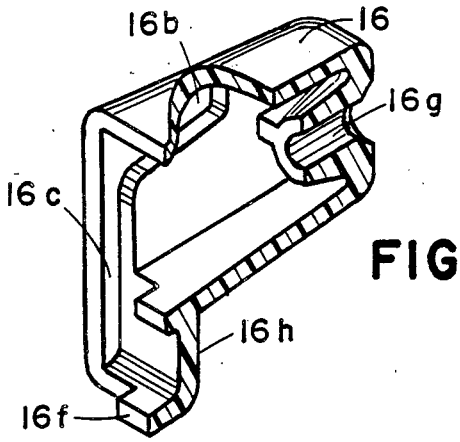
FIG. 2 is a sectional perspective view of the polymeric shell of FIG. 1.
Figure 5:
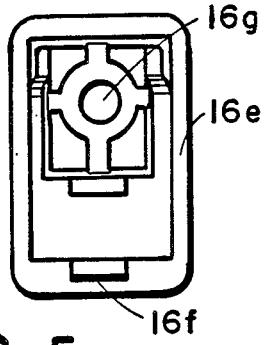
FIG. 5 is an inner end elevational view of the shell component.
Figure 3:
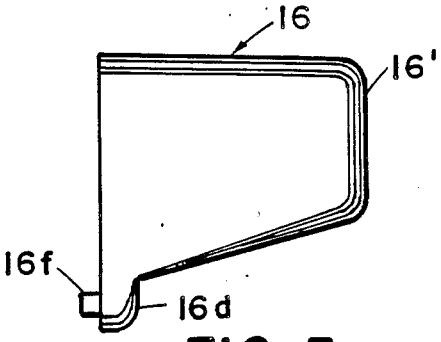
FIG. 3 is a side elevational view of the polymeric shell component.
Figure 4:
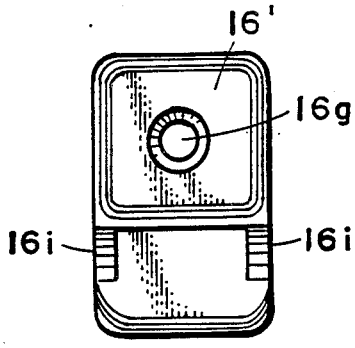
FIG. 4 is an outer end elevational view of the shell component.
Figure 6:
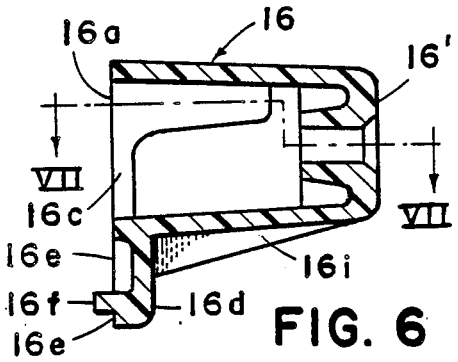
FIG. 6 is an elevational sectional view taken on plane VI—VI of FIG. 7.
Figure 7:
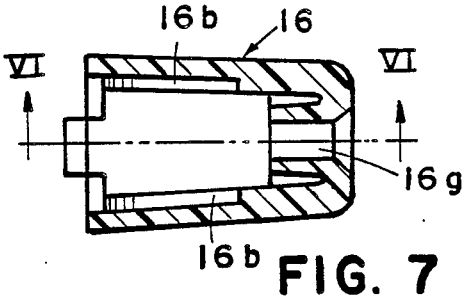
FIG. 7 is a sectional view taken on plane VII—VII of FIG. 6.

In FIG. 1 is illustrated the combination support assembly 10 which includes a conventional metal V-clip support 12 specially interfitted with the novel rigid polymeric fastener shell 16. This fastener shell 16 is shown more specifically in FIGS. 2–7. It includes a main body which has a hollow interior. The body has an outer end 16' and an inner end 16'', the inner end having an opening **16*a* into the hollow interior. A configurated slide channel extending from inner end 16*a* includes a pair of elongated, vertically-convergent recesses 16*b* on the opposite sides of the hollow interior. Each recess has a downwardly extending portion 16*c* into which a depending portion of the V-clip support fits. Depending from the inner end of member 16 is a shoulder 16*d* which has a pilaster abutting surface 16*e* on the inner face thereof. Surface 16*e* may be a peripheral surface as shown, or may extend across the width of the inner end if desired. At the lower portion of this surface is an inwardly protruding tab 16*f*** for engaging one of the horizontally elongated slots in the standard pilaster strip, below the two slots which are engaged by a pair of tabs on the V-clip support, in a manner to be described hereinafter.

Figure 8:
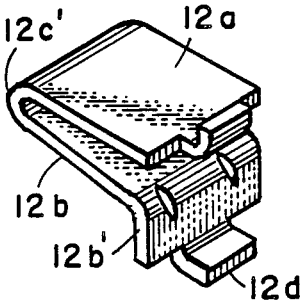
FIG. 8 is a perspective view from the inner end of the conventional V-clip support forming part of the novel combination.
Figure 9:
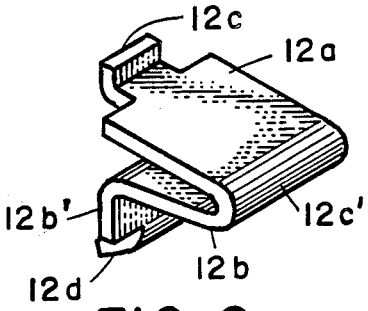
FIG. 9 is a perspective view from the outer end of the V-clip support.
Figure 10:
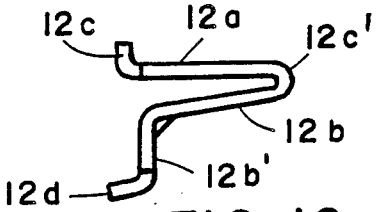
FIG. 10 is a side elevational view of the conventional V-clip support.
Figure 11:
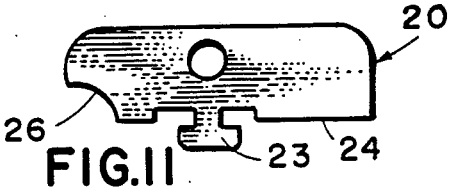
FIG. 11 is a side elevational view of the novel locking clip, useful with the combination.

At outer end 16' is an elongated opening **16*g* for receiving a fastener such as a screw which mounts the slide rail, e.g., the case rail of a drawer rail assembly, to component 16. On the outwardly exposed face of the depending portion of shell component 16, i.e., generally opposite tab 16*f*, is a shoulder surface 16*h* to be engaged by the locking clip 20 in FIGS. 8–10 in a manner to be described hereinafter. A pair of diagonal reinforcing ribs 16*i* extend downwardly and inwardly from the outer end portion of the body to the depending shoulder of this member 16**.

Figure 13:
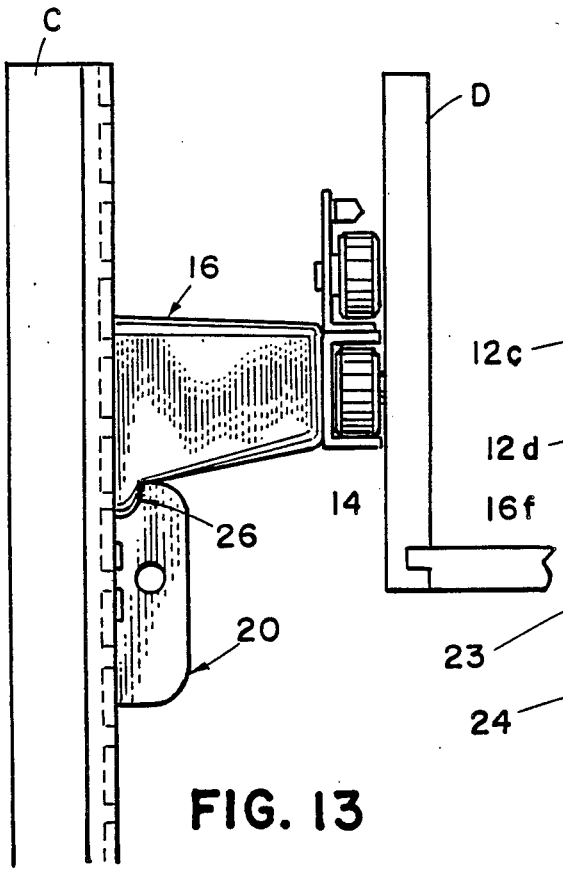
FIG. 13 is an elevational sectional view of the combination in FIG. 12, with a portion of an added drawer and its drawer rail.
Figure 14:
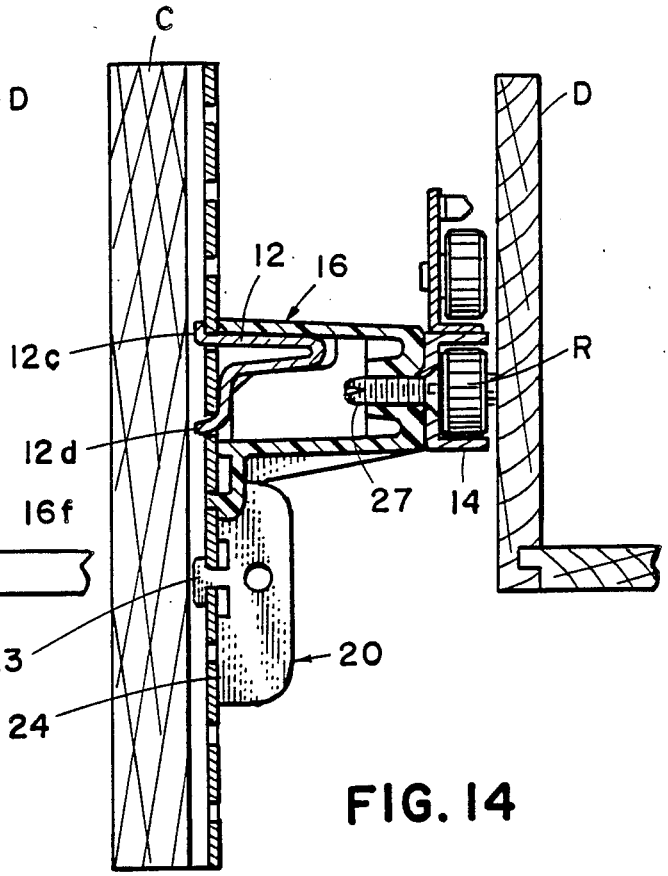
FIG. 14 is a sectional view of the apparatus in FIG. 13.

This novel shell member specially interfits with and cooperates with the conventional V-clip support 12 (FIGS. 1, 13 and 14). The clip support has a pair of generally flat upper and lower legs **12*a* and 12*b* respectively, spaced from each other and divergent from the outer joining apex 12*c'*. The inner end of the upper leg has an upwardly extending tab 12*c* that fits into one of the conventional slots of the pilaster strip 22, and up behind the inner wall surface thereof for support (FIG. 14). The lower leg has a downwardly extending leg portion 12*b'* which terminates in an inwardly extending tab 12***d* for insertion into another lower slot of the standard pilaster strip. The inner face of depending portion 12*b'* serves to abut against the pilaster strip outer face.

The V-clip interfits specially with the polymeric shell 16. More specifically, the outwardly extending V portion formed by legs 12*a* and 12*b* slide into the like configurated recesses 16*b* on opposite sides of the polymeric shell, with the downwardly depending leg portion 12*b'* ultimately nesting into recess portion 16*c* of member 16.

When the V-clip support is so interfitted within the shell, tabs 12*c* and 12*d* are the only portions thereof protruding from the shell, at the inner end thereof, to fit within a pair of vertically spaced slots in the standard pilaster strip. When so fitted, tab 16*e* of the shell fits within another such slot spaced below the tab 12*d*.

Figure 12:
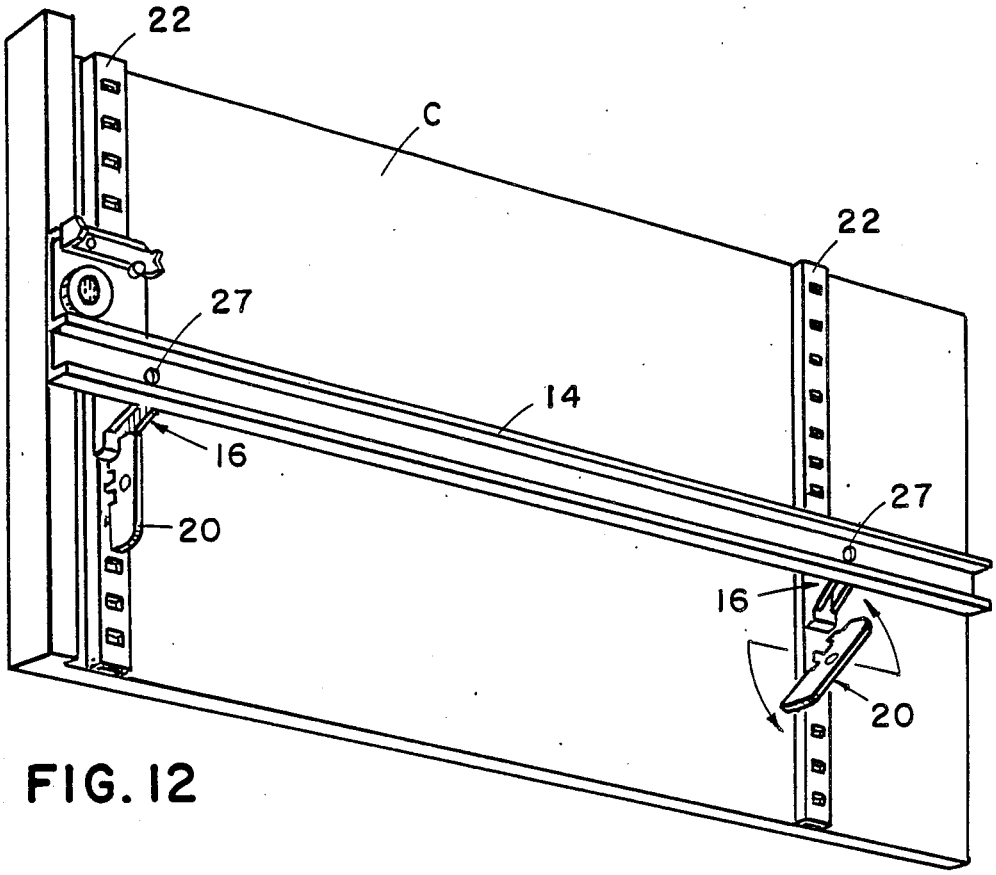
FIG. 12 is a perspective view of a drawer slide rail mounted by two sets of the novel combination using spaced, parallel, vertical pilaster strips at the two ends of the rail.

The case rail 14 of a drawer rail assembly is secured to these components by a screw fastener 27, typically a self tapping screw, which extends through the case rail (FIG. 14) to be threadably attached into the peripheral wall of opening 16*g* of the rigid polymeric shell. By using a spaced pair of these assemblies as in FIG. 12, the case rail will have both ends securely mounted to the pair of spaced parallel pilaster strips. These in turn are mounted in conventional fashion by suitable screws or the like (not shown) to the inside of the cabinet C of a desk or other article of furniture. The drawer D is supported on suitable rollers R, for example, resting on the track of case rail 14.

This case rail can be vertically adjusted to the desired elevation by simply pulling up in rotational manner on the lower portion thereof, to detach tabs 16*f* and tabs 12*d* from the pilaster slots, then retracting tabs 12*c* from their slots, moving the assembly vertically to the desired elevation, and reattaching the assembly by first inserting upper tabs 12*c* and then rotating the case rail downwardly and inwardly to insert tabs 12*d* and 16*e* in underlying pilaster slots.

The weight of the rails, and any drawer and contents therein, is applied to the pilaster strips, partly through the V-clip supports 12 and partly to the pilaster strips directly through the abutment surfaces 16*e*.

Preferably the individual support assemblies are locked into place on the pilaster strips by hold down locking clips 20 (FIGS. 11–14). These clips are a sheet metal component which have a T-shaped configurated tongue 23 extending laterally from the central portion thereof, a pilaster abutment surface 24 on the lower portion, and a shoulder-engaging concave surface 26 on the upper end portion. This tongue 23 can be inserted into the horizontally elongated pilaster slot by positioning the locking clip horizontally. Then by twisting, i.e., rotating the clip 90 degrees to a vertical orientation, the T-shaped tongue will be oriented vertically for locking it behind the rear wall of the pilaster, i.e., above and below the slot, while simultaneously bringing the pilaster abutment surface 24 into engagement with the pilaster 22 and the concave surface into engagement with the depending shoulder 16*d* of the shell component to hold the shell component against the pilaster strip. By locking this lower portion of the shell component against the pilaster strip, the assembly of shell and V-clip support are prevented from being retracted away from the pilaster strip. Release of the locking clip is achieved simply by rotating it again to a horizontal orientation.

It would be possible to alter some of the details of the preferred embodiment set forth to illustrate the inventive mounting device, without departing from the invention. The invention is intended to be limited only by the scope of the appended claims and the equivalent structures to that defined thereby.

The embodiments of the invention in which an exclusive property or privilege is claimed are defined as follows:

1. A rigid polymeric fastener shell comprising a body having an inner end and an outer end;

said inner end having an opening and an adjacent slide channel to receive and envelope a V-clip support, an abutment surface below said opening for abutment with a pilaster strip, and a tab protruding below said opening to project into a slot of a pilaster strip; and said outer end having means for receiving a fastener for attachment of a slide rail thereto.

2. The polymeric fastener shell in claim 1 including a V-clip support and wherein:

said V-clip support has a pair of vertically spaced legs joined at an outer apex therebetween, and said slide channel has portions configurated comparable to said clip support.

3. The polymeric fastener shell in claim 2 wherein:

said V-clip support lower leg has a downwardly oriented terminal portion ending in a projecting tab; and said shell channel includes a downwardly extending portion receiving and enveloping said terminal portion of said V-clip support.

4. A drawer slide rail support apparatus comprising:

a pilaster strip having vertically spaced slots;

a V-clip support protruding from said pilaster strip and including upper and lower tabs forming a removable fit with certain of said slots in said pilaster strip;

a rigid polymeric fastener shell having a body with an inner end and outer end;

said inner end having an opening and an adjacent slide channel receiving and enveloping said V-clip support;

an abutment surface below said opening for abutment with said pilaster strip, and a tab protruding below said opening to project into another one of said slots of said pilaster strip; and said shell outer end having means for receiving a fastener for attachment of a drawer slide rail thereto.

5. The slide rail support apparatus in claim 4 wherein:

said V-clip support has a pair of vertically spaced legs joined at an outer apex therebetween and said slide channel has a configuration comparable to that of said clip support.

6. The slide rail support apparatus in claim 5 wherein:

said V-clip support lower leg has a downwardly oriented terminal portion ending in said lower tab; and said shell recess includes a vertical portion receiving and enveloping said terminal portion of said clip support.

7. The apparatus in claim 4 wherein:

said shell has a depending shoulder and said apparatus includes a twistable locking clip engageable in one of said pilaster slots beneath said shell and rotational to lockingly engage said shoulder.

8. The apparatus in claim 7 wherein:

said locking clip has a tongue for engagement with a slot of said pilaster strip, a pilaster abutment surface beneath said tongue, and a shoulder-abutment surface above said tongue for engagement with said depending shoulder on said shell.

9. A mounting device combination for support of an article on a standard slotted pilaster strip comprising:

a polymeric fastener shell member and a V-clip support interfitting therewith;

said shell member having an outer end for attachment to an article to be supported, and an inner end;

said inner end having an opening and a receiving channel configurated to receive a V-clip support therein;

said V-clip support having a pair of legs convergent toward and joined at an apex, and having a pair of upper and lower tabs to be inserted into slots of the pilaster strip;

said V-clip support being enveloped within said shell member except for said tabs which protrude from said shell member inner end, whereby an article attached to said shell member outer end can be supported on the pilaster strip.

10. The combination in claim 9 wherein said shell member includes a pilaster abutment surface on said inner end beneath said opening.

11. The combination in claim 10 wherein said shell member has a tab protruding beneath said opening to project into a slot of the pilaster strip.

* * * * *